United States Patent [19]

Morita

[11] Patent Number: 4,673,175

[45] Date of Patent: Jun. 16, 1987

[54] PAPER FEEDING DEVICE FOR BOX MAKING MACHINE

[75] Inventor: Shinichi Morita, Yanai, Japan

[73] Assignee: Sun Engineering Co., Ltd., Tokyo, Japan

[21] Appl. No.: 772,506

[22] Filed: Sep. 4, 1985

[30] Foreign Application Priority Data

Sep. 27, 1984 [JP] Japan ..... 59-202552

[51] Int. Cl.[4] ..... B65H 7/02

[52] U.S. Cl. ..... 271/10; 271/259; 271/265; 271/270; 271/271

[58] Field of Search ..... 271/10, 11, 12, 24, 271/25, 104, 229, 230, 235, 256, 258, 259, 264, 265, 270, 271

[56] References Cited

U.S. PATENT DOCUMENTS 3,981,493 9/1976 Klappenecker et al. ..... 271/10

*Primary Examiner*—Richard A. Schacher

*Attorney, Agent, or Firm*—Armstrong, Nikaido, Marmelstein & Kubovcik

[57] ABSTRACT

The paper feeding device for a box making machine eliminates the intermittent paper feeding which gives rise to operational defects. The device operates continuously at a low speed to match the speed of feeding a quantity of paper with a timing correcting conveyor and increases the paper fed in the foregoing with the drawing belt conveyor in order to supply the paper to the timing correcting conveyor. Furthermore, the device detects the paper passing the shutter on the paper feeding belt conveyor and stops the paper feeding belt conveyor temporarily when the paper happens to be mounted on the pawl of the timing correcting conveyor. The feeding of the paper starts again after a time lapse so that the paper is positively mounted between the pawls.

5 Claims, 3 Drawing Figures

PAPER FEEDING DEVICE FOR BOX MAKING MACHINE

BACKGROUND OF THE INVENTION

This invention relates to a paper feeding device for a box making machine which supplies flat, cut paper of a predetermined shape during predetermined intervals for bending and pasting.

Heretofore, a paper feeding device 10 shown in FIG. 3 was used. The paper feeding device 10 is constructed such that laminated paper 12 is stacked and mounted on a paper feeding belt conveyor 11 and the paper is fed one sheet at a time through a gap at the lower end of a shutter 13. The shutter 13 abuts the front end of the paper 12. A timing correcting conveyor 16 is used to feed the paper through a drawing belt conveyor 14. The paper is then pushed by a pawl 15 mounted on a chain. Thus, the paper is supplied at predetermined intervals. In the device 10, the paper from the drawing belt conveyor 14 may ride up onto a pawl 15 of the timing correcting conveyor 16, and is thus not properly fed downstream. In order to prevent this from occuring, the laminated paper 12 on the feeding conveyor 11 is stopped from being fed using a bar 17 provided between the belts. The bar 17 lifts the stack at predetermined intervals and thus, the paper is fed intermittently from a paper feeding belt conveyor 11.

In the device 10, when the stack of laminated paper 12 is lowered by bar 17 and the paper starts to feed onto the paper feeding belt conveyor 11, slippage can occur temporarily between the paper and the belts. The slipping time is variable among the paper sheets so that the paper feeding belt conveyor 11 does not accurately feed the paper in sychronization with the timing correcting conveyor 16 so that an operation defect such as the paper riding up onto the pawl 15 tends to occur. Also, the tendency for this operation defect to occur is increased at higher operational speeds, and thus it is difficult to speed up the operation of the device 10. Furthermore, when the paper 12 stacked on the paper feeding belt conveyor 11 moves vertically, the ratio of the time of lifting the paper to the time of lowering the paper must be adjusted according to a) the entire length of the paper and b) the speed of the paper feeding onto belt conveyor 11. However, this adjustment requires much trial and error and also numerous cumbersome operations are also required.

SUMMARY OF THE INVENTION

This invention provides a paper feeding device eliminating the foregoing drawbacks and lessening the occurrence of any operational defects. Therefore, high speed operation is possible and in addition allows an easy adjustment for the change in size of paper fed into the device.

Namely, the paper feeding device of this invention eliminates intermittent paper feeding which causes operational defects. The inventive device operates continuously at a low speed to match a feeding quantity of the paper with the timing correcting conveyor. The device also expands the interval between the paper sheets fed in the paper feeding conveyor and the drawing belt conveyor in order to supply the paper to the timing correcting conveyor. Furthermore, the device detects when the paper sheet passes the shutter on the paper feeding belt conveyor and stops the paper feeding belt conveyor temporarily in case the paper sheet happens to ride up onto the pawl of the timing correcting conveyor. The device starts feeding the paper again by waiting until the paper sheet is positively mounted between the pawls of the timing correcting conveyor.

As described in the foregoing, an object of this invention is to provide a paper feeding device for a box making machine.

The above and other objects and aspects of the invention will be more clearly understood from the following description of the embodiments of the invention shown, by way of examples only, in the accompanying drawings in which like reference numerals denote corresponding parts throughout the several views.

DETAILED DESCRIPTION OF THE INVENTION

Figure 1:
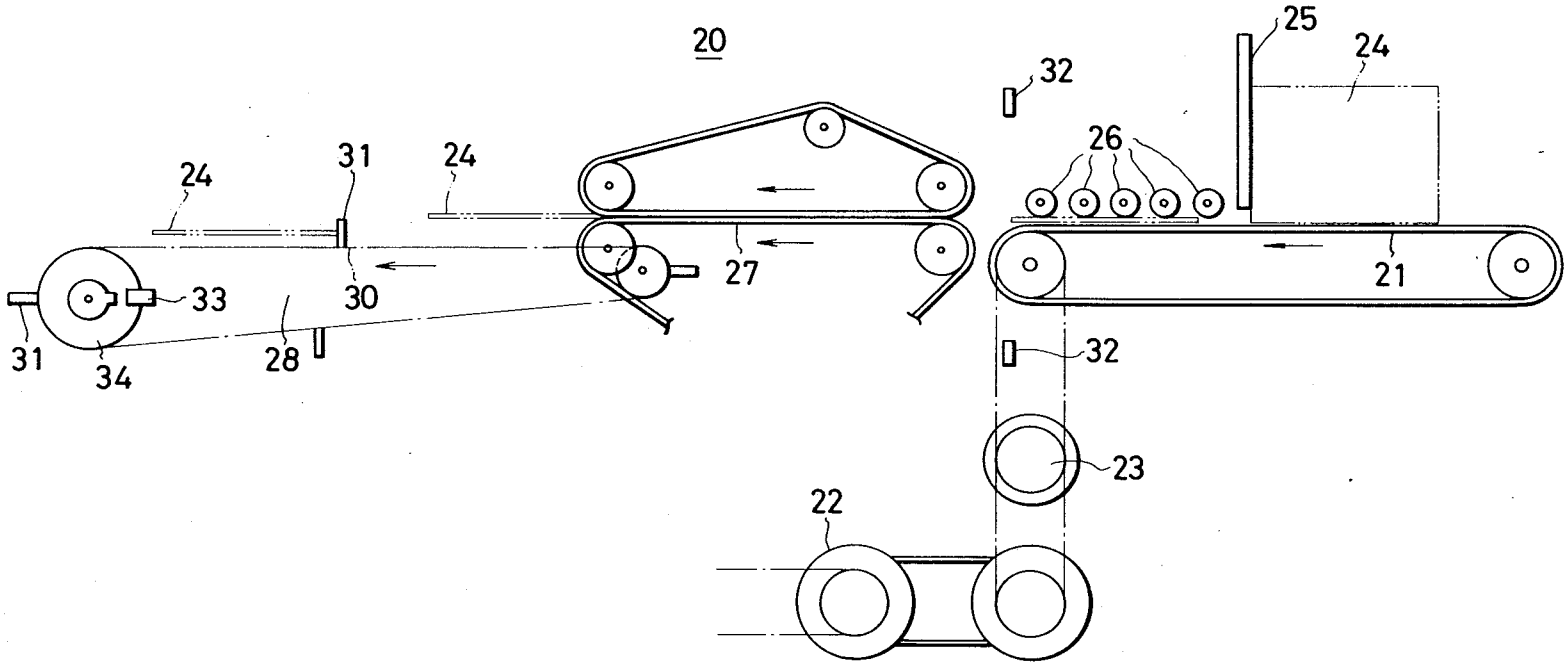
FIG. 1 is an elevation showing an embodiment of this invention.
Figure 2:
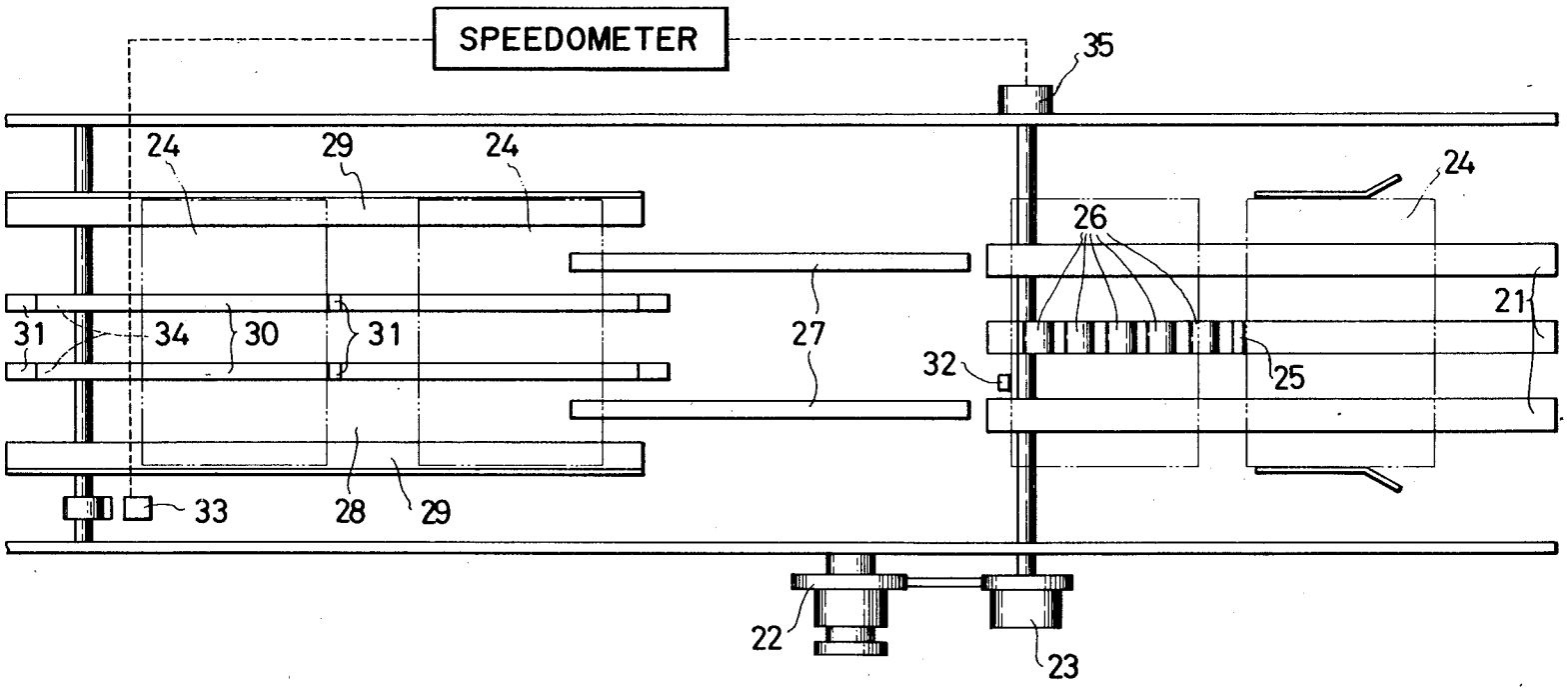
FIG. 2 is a plan showing the embodiment of this invention.
Figure 3:
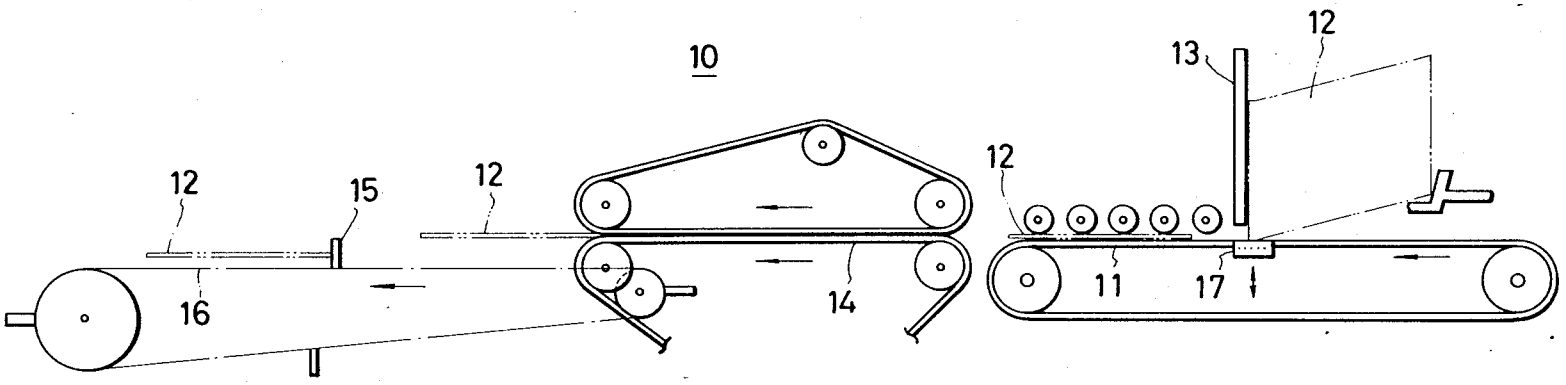
FIG. 3 (PRIOR ART)
FIG. 3 is an elevation showing a conventional example.

This invention shown in FIGS. 1 and 2 will be described in the following by referring to an embodiment of this invention. In the paper feeding device 20, a paper feeding belt conveyor 21 is driven by a speed change gear 22 and clutch brake 23. A stack of paper sheets 24 is mounted on the paper feeding belt conveyor 21, and the paper is made to pass one sheet at a time through a gap at a lower end of a shutter 25. The shutter 25 abuts the front end of the paper stack to feed the paper sheets continuously. Each paper sheet that passes the shutter 25 is urged against the belt by rollers 26, . . . 26. A drawing belt conveyor 27 receives the paper sheets 24 fed from the paper feeding belt conveyor 21, and transfers the sheets by sandwiching the paper sheets vertically between the upper and lower belts of the conveyor 27. The transfer speed of the drawing belt conveyor 27 is faster than the paper feeding belt conveyor 21. Therefore, the interval between the paper sheets fed continuously from the paper feeding belt conveyor 21 is increased. The paper sheet 24 fed from the drawing belt conveyor 27 is mounted on a guide 29 of a timing correcting conveyor 28. The paper sheet 24 is pushed with a pawl 31 mounted on a chain 30 whereby the paper sheet is shifted or moved. The transfer speed of the timing correcting conveyor 28 is equal to that of the drawing belt conveyor 27. Also, the feeding of the paper is set to coincide with the timing of the next (downstream) process.

A paper detector 32 comprises a light source and a light sensor. The light detector 32 is disposed at an outlet portion of the paper feeding belt conveyor 21. When the front end leading edge of the paper sheet 24 passes the shutter 25, the sheet 24 is detected by the dectector 32. A pawl detector 33 comprises a proximity switch to detect the rotation of a sprocket 34 that spans the chain 30 of the timing correcting conveyor 28. When the pawl 31 advances by an interval equal to one pawl length, the sprocket 34 makes one turn, whereby the detector 33 outputs one pulse. Furthermore, a control device (not shown in the drawing) is provided, and receives the output of the paper detector 32 and the pawl detector 33. The control device operates the paper feeding belt conveyor 21 in an allowable range that has been previously set at a predetermined quantity phase difference between an output pulse of the pawl detector 33 and an output of the paper detector 32. When the output of the paper detector 32 is out of the allowable range, the control device operates the clutch brake 23 to stop the paper feeding belt conveyor 21. The control device starts the operation of the paper feeding belt conveyor 21 again when the phase difference is within the next allowable range.

A pulse generator 35 is mounted on the paper feeding belt conveyor 21. The generator 35 transmits a row of pulses according to the rate of advancement of the belt in the feed direction. Furthermore, a speedometer (not shown in the drawing) receives outputs of the pulse generator 35 and the pawl detector 33. The speedometer displays the advanced distance of the paper feeding belt conveyor 21 in the feeding direction per advancement of an interval of one pawl of the timing correcting conveyor 28. The distance is measured by counting the output pulses of the pulse generator 35 and the output pulses of the pawl detector 33.

The paper feeding device 20 operates as follows. First, an allowable range of the control device is set in which the paper sheets are feed at a rate to be placed in between the pawls 31 positively without riding up onto the pawls 31 of the timing correcting conveyor 28. Namely, the paper is fed at a rate to produce an output of the paper detector 32 at the begininning of the allowable range as the paper advances. That is, an output will occur when the front end leading edge of the paper is located at a position just behind the pawl 31. This marks the beginning of the allowable range. The end of the allowable range occurs when the rear end of the paper sheet is located at a position just before the next pawl 31. The paper detector 32 detects the front end of the paper 24, so that once the begininning of the allowable range is set, a succeeding adjustment is not needed. However, the end of the allowable range must be reset according to the length of paper used in the device. The position at which the paper feeding belt conveyor 21 is restarted is set at approximately the middle of the allowable range.

Next, the operator watches the speedometer and adjusts the speed of the paper feeding belt conveyor 21 using the speed change gear 22 to make the display to be equal or slightly larger than an entire length of the paper 24 used. When this adjustment is made, the paper feeding belt conveyor 21 feeds the paper 24 continuously and one sheet of the paper is fed at each one pawl interval by the timing correcting conveyor 28 so that the feeding quantities per time of both the conveyors are equal or the feeding quantity of the paper feeding belt conveyor 21 is slightly greater.

When the device is operated in the foregoing manner, the paper feeding belt conveyor 21 feeds the paper 24 continuously, and the drawing belt conveyor 27 increases the interval between the feeding sheets of the paper and placing the paper 24 between the pawls 31 of the timing correcting conveyor 28. The timing correcting conveyor 28 pushes the paper with the pawl 31, and the paper is fed to the next downstream process at the proper timing. If the front end of the paper fed from the paper feeding belt conveyor 21 should tide upon the pawl 31, then the output of the paper detector 32 which detected the paper produces a deviation in the beginning of the allowable range so that the paper feeding belt conveyor 21 is stopped temporarily by the control device so that the feeding of the paper is stopped. When the paper feeding belt conveyor 21 is restarted, the paper is placed positively between the pawls 31. Also, when the rear edge of the paper fed from the paper feeding belt conveyor 21 rises over the pawl 31, the output of the paper detector 32 having detected the paper produces a deviation at the rear part or end of the allowable range so that the paper feeding belt conveyor 21 is stopped temporarily by the control device. When the paper is positively placed between the pawls 31, the conveyor 21 is started again. However, in this case, a pawl of the timing correcting conveyor 28 makes one idle feeding or feed traverse. Accordingly, in order to avoid the idle feeding or feed traverse, as described in the foregoing, the paper feeding belt conveyor 21 is operated at a slightly faster rate than conveyor 28.

In this embodiment, although the adjustment operation needed when the size of paper is changed is simplified by providing the speedometer, it is also possible to adjust the speed of the paper feeding belt conveyor by watching the stopping frequency of the paper feeding belt conveyor thereby eliminating the speedometer.

The foregoing embodiment is for a continuous feeding paper feeding device whereas the conventional device intermittently feeds paper one sheet at a time by a paper feeding belt conveyor. The operation of the present embodiment is stable, and when the paper feeding device is repeatedly stopped and started by the control device, there is no slippage. Once the paper passes the shutter, it is controlled by the control device so that the invention operates positively. For this reason, the operational defects of the paper riding over the pawl seldom occurs. Also, it is easy to operate the device at high speed without increasing the operational defects. Furthermore, the adjustment of the control device for a change in the size of the paper can easily be made by merely resetting the end of the allowable range according to the overall length of the paper sheet, and particularly, when a numerical value of the length of the paper is displayed on the setting operation unit, its operation becomes much easier. Also, the adjustment of the speed of the paper feeding belt conveyor may be carried out by either watching the speedometer when the speedometer is provided or watching the stopping frequency of the paper feeding belt conveyor if the speedometer is not used. Moreover, this adjustment never causes the operational defects so that it can be done simply.

The invention has been described in detail with particular reference to preferred embodiments thereof, but it will be understood that variations and modifications can be effected within the spirit and scope of the invention.

What is claimed is:

1. A continuous paper feeding device for a box making machine comprising:

a paper feeding belt conveyor means for mounting a plurality of sheets of paper thereon and for passing one sheet of said paper through a gap at a lower end of a shutter means abutting on a front end of said paper and for feeding said paper continuously, a drawing belt conveyor means for receiving said paper from said paper feeding belt conveyor means, said drawing belt conveyor means operating at a higher speed than said paper feeding belt conveyor means and expanding a paper feeding interval, a timing correcting conveyor means for mounting said paper fed from said drawing belt conveyor means and for transferring said paper with a pawl means one sheet at a time to feed said paper at a predetermined timing, a paper detector means for detecting when said paper passes said shutter means on said paper feeding belt conveyor means, a pawl detector means for detecting a position of said pawl means of said timing correcting conveyor means, and a control device means for receiving outputs of both said paper detector means and said pawl detector means and for stopping the continuous feeding of said paper by stopping said paper feeding belt conveyor only when said paper is detected riding up onto said pawl means of said timing correcting conveyor means as said paper continues to advance and for restarting the continuous feeding of said paper again by waiting until said paper is not mounted on said pawl means.

2. A continuous feeding device for a box making machine according to claim 1 further comprising a pulse generator means operating by the advancement of said paper feeding belt conveyor means, and a speedometer means for receiving outputs from said pulse generator means and said pawl detector means, said speedometer means showing a distance advanced by said paper feeding belt conveyor means per one pawl means interval advancement of said timing correcting conveyor means.

3. A continuous paper feeding device for a box making machine according to claim 1 further comprising urging means for urging each of said sheets of paper against said paper feeding belt conveyor means after each of said sheets of paper passes said shutter means.

4. A continuous paper feeding device for a box making machine according to claim 3 wherein said urging means are rollers.

5. A continuous paper feeding device for a box making machine according to claim 1, wherein said drawing belt conveyor means includes upper and lower belt conveyor means.

* * * * *